US005281284A

United States Patent [19]

Ueda et al.

[11] Patent Number: 5,281,284

[45] Date of Patent: Jan. 25, 1994

[54] PROCESS FOR PRODUCING THIN SHEET OF CR-NI-BASED STAINLESS STEEL HAVING EXCELLENT SURFACE QUALITY AND WORKABILITY

[75] Inventors: Masanori Ueda; Shin-ich Teraoka, both of Futtsu; Toshiyuki Suehiro, Hikari; Hideki Oka, Hikari; Yuuji Yoshimura, Hikari, all of Japan

[73] Assignee: Nippon Steel Corporation, Tokyo, Japan

[21] Appl. No.: 934,600

[22] Filed: Aug. 24, 1992

[30] Foreign Application Priority Data

| | | | |
|---|---|---|---|
| Aug. 28, 1991 | [JP] | Japan | 3-217591 |
| Aug. 28, 1991 | [JP] | Japan | 3-217597 |
| Aug. 28, 1991 | [JP] | Japan | 3-217598 |
| Aug. 28, 1991 | [JP] | Japan | 3-217600 |
| Aug. 28, 1991 | [JP] | Japan | 3-217603 |

[51] Int. Cl.[5] ..... C21D 8/00

[52] U.S. Cl. ..... 148/542; 148/546

[58] Field of Search ..... 148/542, 546

[56] References Cited

FOREIGN PATENT DOCUMENTS 2-19426 1/1990 Japan .
2-133522 5/1990 Japan .
2-133528 5/1990 Japan .
2-133529 5/1990 Japan .
2-182353 7/1990 Japan .
3-285023 1/1991 Japan .

OTHER PUBLICATIONS

CAMP-ISIJ, vol. 3, pp. 769 and 770 (1990).
CAMP-ISIJ, vol. 1, pp. 1674-1705, (1988).
Nisshin-Seiko Giho, No. 62, pp. 62-78, Jun. 1990.

*Primary Examiner*—Deborah Yee
*Attorney, Agent, or Firm*—Kenyon & Kenyon

[57] ABSTRACT

A process for producing a thin sheet of a Cr-Ni-based stainless steel having excellent surface quality and workability is produced by continuously casting a stainless steel represented by 18%Cr-8%Ni steel by means of a continuous casting machine having a mold wall surface that moves in synchronization with a cast strip, effecting rapid solidification at a cooling rate of 100° C./sec or more into a cast strip having a thickness of 10 mm or less; after solidification thereof, initiating cooling of the cast strip from a high temperature at a rate of 100° C./sec or more to 1250° C. and preventing the occurrence of recuperation; holding the cooled cast strip in a temperature range of from over 900 to 1250° C. exclusive for 5 sec to 2 min; and cooling and coiling the cast strip and subjecting the cast strip to annealing, pickling, cold rolling and annealing.

12 Claims, 5 Drawing Sheets

PROCESS FOR PRODUCING THIN SHEET OF CR-NI-BASED STAINLESS STEEL HAVING EXCELLENT SURFACE QUALITY AND WORKABILITY

BACKGROUND OF THE INVENTION (1) Field of the Invention

The present invention relates to a process for producing a thin sheet of a Cr-Ni-based stainless steel having excellent surface quality and workability, comprising bringing the thickness of a cast material to a thickness close to the thickness of a product through the so called "synchronous continuous casting process" which does not give rise to a difference in the relative speed between a cast material and the inner wall surface of a mold, wherein the structure of the cast material is refined at a casting stage and, at the same time, MnS is precipitated.

(2) Description of the Prior Art

A thin sheet of a stainless steel has hitherto been produced by a continuous casting process that comprises casting a stainless steel into a cast slab having a thickness of 100 mm or more while vibrating a mold in the direction of casting, surface-grinding the slab, heating the grinding slab to 1000° C. or above in a heating furnace, hot rolling the heated slab into a hot strip having a thickness of several millimeters by means of a hot strip mill comprising a rough rolling mill and a series of finishing rolling mills.

In the cold rolling of the hot strip thus obtained, in order to ensure the configuration (flatness), the quality of the material and the surface quality, the hot rolled sheet was annealed for the purpose of softening the hot strip subjected to strong hot working, and scale etc. on the surface of the hot strip was removed by grinding after the step of pickling. This conventional process needed long and large hot rolling facilities and a great amount of energy for heating and working the material. For this reason, this process was also not regarded as an excellent production process from the viewpoint of productivity. Further, since the final product is obtained by subjecting a cast slab having a thickness of 100 mm or more to many working treatments, a texture develops. For this reason, a user should consider an anisotropy in the final product when said final product is press working by the user. Thus, the above process also had many usage limitations In recent years, studies on a process for producing a cast material (hereinafter referred to as "cast strip") having a thickness equal to or close to the thickness of a hot strip in the course of the continuous casting have developed with a view to solving the problem concerning the necessity of long and large hot rolling facilities and a great amount of energy and rolling power for rolling a cast slab having a thickness of 100 mm or more into a hot strip. For example, an article featured in "Tetsu to Hagane (Iron and Steel)", '85, A197–'85, A256 discloses a process wherein a hot strip is directly produced by continuous casting. In such a continuous casting process (hereinafter referred to as "novel process"), the use of a twin drum system is studied when the gauge of the cast strip to be produced is on the level of 1 to 10 mm, while the use of a twin belt system is studied when the gauge of the cast strip is on the level of 20 to 50 mm.

In these novel processes, however, a problem exists in the stage of casting as well, and problems with respect to the quality of the product and the surface quality remains unsolved.

"CAMP ISIJ", vol. 3, 1990, p. 770 reports that a surface defect in an orange peel form on the surface of the cast strip occurs, therefore the $\gamma$ grain diameter in the cast strip before could rolling must be refined An article featured in "CAMP ISIJ", vol. 1, 1988, p. 1674–1705 describes that a SUS304 thin sheet product obtained by a twin drum casting and a single cold rolling process has a finer grain structure than that produced by the conventional process and has a low elongation and, in order to prevent this phenomenon, the cast strip is annealed at a high temperature for a long period of time to remove the $\delta$ ferrite remaining in the cast strip.

In a process of which the development has been advanced as a novel process on the conditions that a cast strip having a thickness equal to or close to a hot strip is produced by continuous casting, since the steps from casting to the final product are simplified, the surface properties and workability of a thin sheet of stainless steel are greatly influenced by the properties of the cast strip. That is, in order to prepare a product having excellent surface quality and workability, it is necessary to prepare an excellent cast strip.

The present inventors have clarified the means for refining a $\gamma$ grain of a cast strip in a method for preventing the occurrence of a roping phenomenon or the above described surface defect called "orange peel phenomenon" in the novel process and in previously filed patent applications.

Japanese Patent Application No. 63-221471:
  Cooling of cast strip and hot rolling
Japanese Patent Application No. 63-169095 (PCT International Publication No. WO 90/00454):
  Cooling of a cast strip and cold rolling and annealing in a two stage (2CR) process
Japanese Patent Application No. 63-221472:
  Cooling of a cast strip and $\delta$ ferrite control
Japanese Patent Application No. 63-286690:
  Cooling of a cast strip and $\delta$ ferrite control
Japanese Patent Application No. 1-1586:
  Cooling of a cast strip and the addition of a grain refining element It has become apparent that in these processes alone, the elongation and workability, which are features of the Cr-Ni-based stainless steel, become unsatisfactory.

In order to solve the above described problem, the present inventors have made detailed studies on a process for producing a thin sheet of a Cr-Ni-based stainless steel. As a result, they have found that the $\delta$ ferrite remaining and fine MnS in a cast strip suppress the growth of recrystallized grain in the annealing after cold rolling and this is causative of a fine grain structure of the final product and a lowering in the elongation attributable thereto, and propose holding the material in a temperature range of from 800° to 1250° C. for the purpose of reducing the $\delta$ ferrite and the same time precipitating MnS coarsely (see Japanese Patent Application No. 2-83024 (PCT International Publication No. WO 91/10517)). Since, however, in the above-described technique, the cast strip should be held in the above described temperature range for 80 min or less (in the working examples, the maximum holding time and the minimum holding time are 900° C.×60 min and 1200° C.×3 min, respectively), it becomes necessary to use long and large holding facilities, which renders the above-described technique unsuitable for practical use.

Further, the present inventors have studied the cooling behavior of the cast strip produced by the above described process and the coarsening behavior of MnS through precipitation and have clarified the requirement for coarsening of MnS, which has led to a solution to a above described problem.

SUMMARY OF THE INVENTION

An object of the present invention is to provide a process for producing a thin sheet of Cr Ni based stainless steel through the above described novel process, which comprises casting a cast strip having a thickness close to the thickness of the product and subjecting the cast strip to cold rolling.

Another object of the present invention is to provide a process for producing a thin sheet of stainless steel excellent, particularly, in workability and elongation during the treatment step (holding at a constant temperature or gradual cooling) for a very short period of time.

A further object of the present invention is to provide a process for producing a thin sheet of stainless steel wherein a main component of the steel is regulated and, if necessary, a crystal grain refining element is added to further reduce a γ-grain diameter of the cast strip for preventing roping and providing a thin sheet of stainless steel excellent, particularly, in surface quality.

A further object of the present invention is to provide a thin sheet of stainless steel having a remarkably improved workability and surface quality using the above described process wherein the resultant cast strip is cold rolled and annealed in two stages (2CR).

In order to attain the above described first object, the present inventors have developed a novel technique comprising a combination of conditions for the production of a cast strip with conditions for cooling in the region of a temperature of 1250° C. or above and conditions for holding in a temperature range of from over 900° to 1250° C.

Specifically, the present inventors have made detailed studies on the behavior of MnS during precipitation during the cooling step and, as a result, have obtained the following acquaintance.

(1) In a cast strip having a temperature of 1250° C. or above, MnS is finely precipitated (in a diameter of about 0.05 μm or less). For this purpose, it is necessary to prevent segregation through quench solidification at a rate of 100° C./sec or more by twin drums and to cool the material to 1250° C. at a rate of 100° C./sec or more.

(2) MnS can be coarsened to a size of about 0.1 to 1 μm by holding the cast strip in a temperature region for coarse precipitation of MnS for a very short period of time of 2 min or less under the above-described condition.

(3) MnS having the above described grain diameter exhibits an excellent elongation without pinning the growth of a recrystallized grain through annealing after cold rolling.

The means for realizing the above technical acquaintance are as follows.

(1) The cast strip is solidified at a rate of 100° C./sec or more (for example, the above-described solidification rate can be easily attained by casting a strip having a thickness of 6 mm or less in a $N_2$ or He atmosphere) to prevent the segregation of MnS, and cooled in a temperature range of from the solidification temperature to 1250° C. at a rate of at least 100° C./sec to a temperature of 1250° C. This enables MnS to be homogeneously and finely dispersed.

(2) The cast strip is held in a temperature range of from over 900° to 1250° C. for 5 sec to 2 min. The holding is conducted by either holding the cast strip at a constant temperature in the above described temperature range, for example, the cast strip is held at 1000° C. for 5 sec in the case of the lower limit of the MnS grain diameter and at 1250° C. for 2 min in the case of the upper limit of the MnS grain diameter or gradually cooling the material at a rate of 20° C./sec or less in the above described temperature range for the above described period of time.

When the holding time in the above described temperature region is less than 5 sec, the diameter of the precipitated MnS grain is so small that the growth of the recrystallized grain is pinned during cold rolling and annealing, and the final product structure is refined so as to deteriorate the elongation of said product. When the holding time exceeds 2 min, improvement of the elongation is no longer possible and, at the same time, the diameter of the γ grain becomes so large that deterioration occurs, particularly in surface quality.

As described above, cooling in a temperature range from the temperature after solidification to 1250° C. at a rate of 100° C./sec or more (the upper limit of the cooling rate is a cooling rate depending upon the cooling capability of the cooling facilities) causes MnS to be finely precipitated without significant segregation and, at the same time, alleviates the occurrence of roping by preventing the growth of γ grains.

Further, the steel compositions of a cast strip are regulated to have a δ-Fe cal(%) in the range of from 0% to 10%, where by a δ ferrite phase as a primary crystal precipitates to part the γ grain and a fine ferrite disperses at a γ grain boundary, as a result, the diameter of the γ grain is further reduced.

The δ-Fe cal(%) is represented by the following formula (unit of each ingredient: wt. %)

$$\delta\text{-Fe cal}(\%) = 3(Cr + 1.5Si + Mo) - 2.8(Ni + 0.5Cu + 0.5Mn) - 84(C + N) - 19.8$$

Further addition of grain refining elements, such as Al, Ti, Nb, Zr, La, Ce, Nd, Y, Ca, Mg and B, enables fine oxides, nitrides, sulfides and carbides precipitated in a molten steel or during or after solidification to be homogeneously dispersed in the γ grain and γ grain boundary, which contributes to a significant prevention of the growth of the γ grain.

In order to attain the effect of an addition of crystal grain refining elements, 0.01% to 1% of one member or 0.01% to 1% in total of at least two members selected from the group consisting of Al, Ti, Nb, Zr, La, Ce and Nd may be added. Alternatively, 0.001% to 1% of one member or 0.001 to 1% in total of at least two members selected from the group consisting of Y, Ca, Mg and B may be added.

After holding in a temperature range of from over 900° to 1250° C., the cast strip is cooled to a coiling temperature. In this case, when the cooling in a temperature range from 600° to 900° C. is conducted at an average cooling rate of 10° C./sec or more, it is possible to prevent the precipitation of chromium carbides, and the step of annealing before cold rolling a cast strip can be omitted. After coiling, the material is subjected to annealing (which may be omitted), pickling, cold rolling and a series of conventional treatments to provide a final product. It is also possible to use a process that comprises, after pickling, subjecting the cast strip to preliminary cold rolling with a reduction ratio of 60% or less, annealing the cold rolled material at a temperature of 850° C. or above for recrystallization so as to bring the average diameter of the $\gamma$ grain to 50 $\mu$m or less, pickling the recrystallized material, cold-rolling the pickled material and subjecting the cold-rolled material to a series of conventional treatments, that is, final annealing, pickling or bright annealing and temper rolling, to provide a final product. The latter process can provide superior surface quality and mechanical properties.

DESCRIPTION OF THE PREFERRED EMBODIMENTS

The present inventors have conducted the following test for the purpose of examining the working properties and surface properties of a final product A molten steel composed mainly of SUS304 steel ($\delta$-Fe cal %=4.1%) was cast by means of an internal water cooling twin drums continuous cast testing machine in a $N_2$ atmosphere into a thin cast strip having a thickness of 3 mm. The average rate of cooling for solidification was 500° C./sec. Immediately after casting, the cooling in a temperature range of from the temperature immediately after casting to 1250° C. was conducted at an average cooling rate of 120° C./sec.

Figure 1:
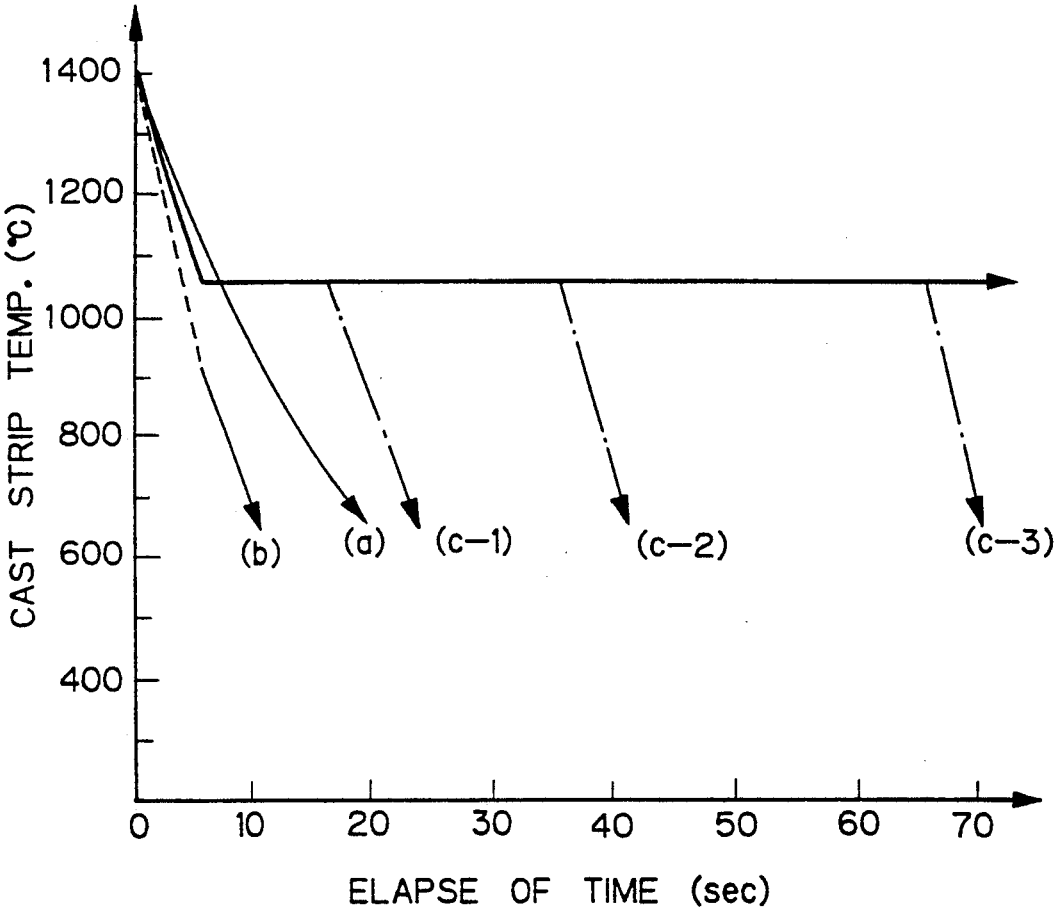
FIG. 1 is a diagram showing a thermal history of a thin cast strip produced by a synchronous continuous casting process.

The cast strip was subjected to a thermal history as shown in FIG. 1 to examined the influence of said thermal history on the final product.

In the drawing, (a) represents a thermal history of a cast strip produced by air cooling after casting by means of experimental twin drums, (b) represents a thermal history of a cast strip produced by rapid cooling by means of water cooled rolls immediately after casting, (c-1) represents a thermal history of a cast strip produced by cooling by means of water-cooled rolls immediately after casting, holding the cast strip at 1050° C. for 10 sec and cooling the cast strip, (c-2) represents a thermal history of a cast strip produced by similarly holding the strip for 30 sec, and (c-3) represents a thermal history of a cast strip produced by similarly holding the strip for 60 sec.

These cast strips were descaled, cold-rolled, annealed, pickled and temper-rolled into a product having a sheet thickness of 0.6 mm. Properties of the final products are given in Table 1. As is apparent from Table 1, the holding of the strip at 1050° C. for 10 to 60 sec contributed to a remarkable improvement in the elongation By the examined results, it was confirmed that combination quenching the cast strip by rapid cooling immediately after casting and holding said cast strip at a decided temperature and time is a very important technique.

Figure 2:
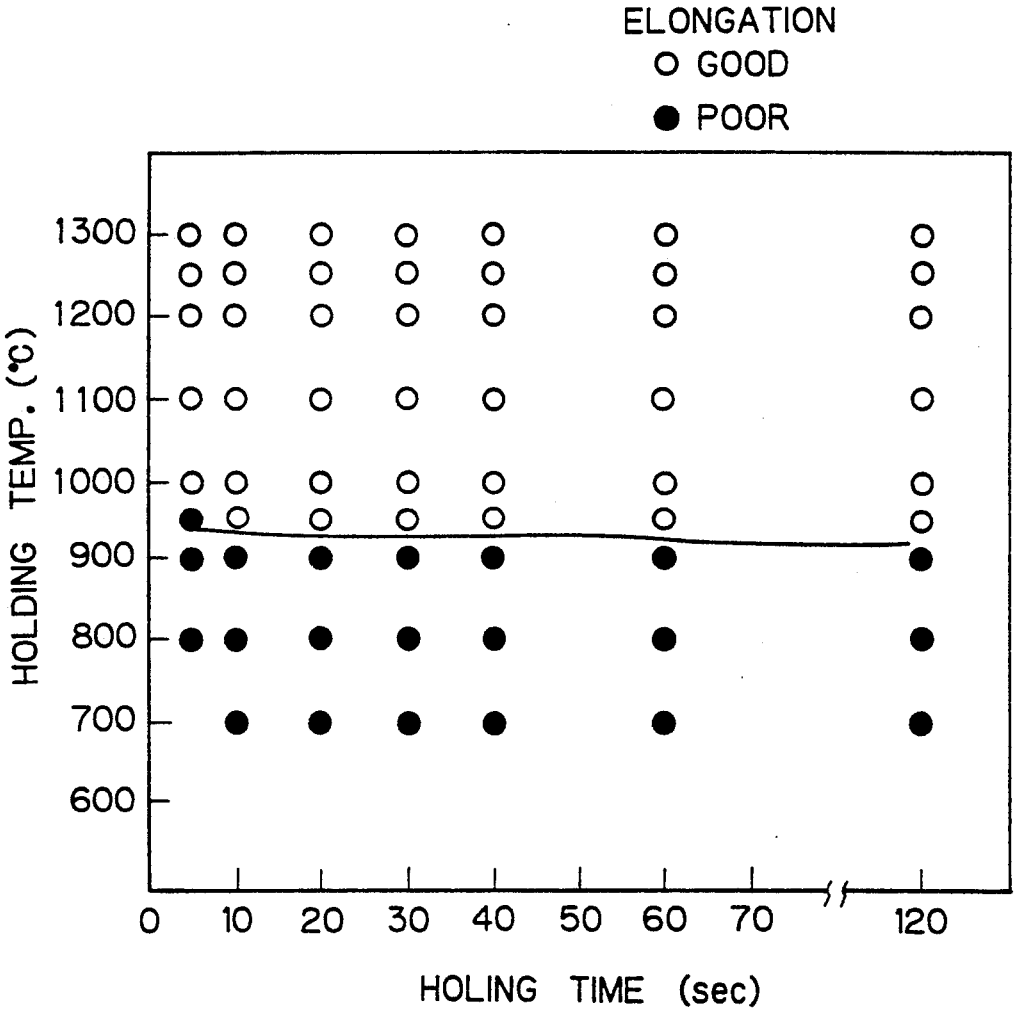
FIG. 2 is a diagram showing the state of elongation of the final product in the direction of rolling when a cast strip produced according to the process of the present invention has been held immediately after casting in a temperature range of from 700° to 1300° C. for 5 sec to 2 min.
Figure 3:
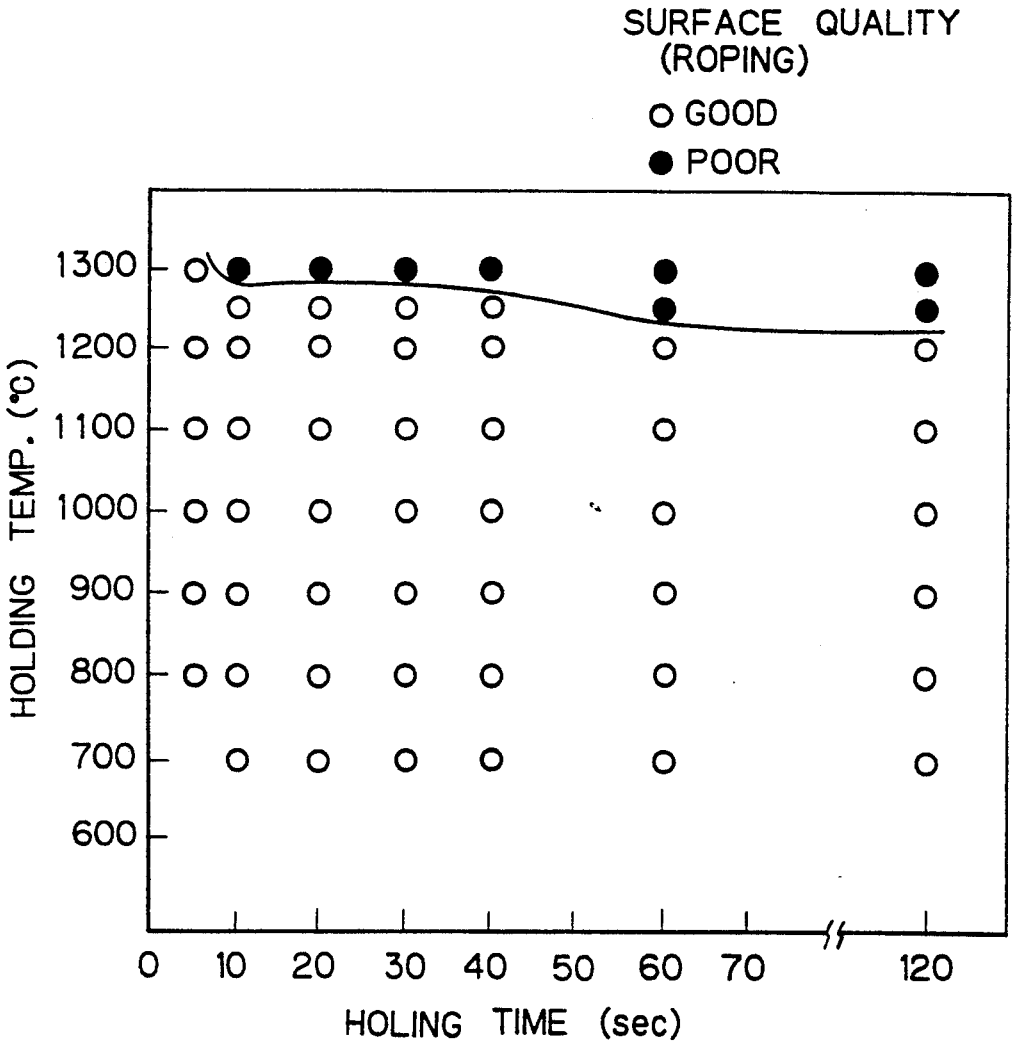
FIG. 3 is a diagram showing the state of roping of the final product when a cast strip strip produced according to the present invention has been held under the same conditions as those in the case of FIG. 1.

Then, to clarify the relationship between the holding temperature and the holding time, the cast strip produced under the above-described conditions was held at a constant temperature in a temperature range of from 700 to 1300° C., and the holding conditions, that is, the relationship between each holding temperature and holding time, and the elongation of the final product after cold rolling and annealing are shown respectively in FIGS. 2 and 3.

Since MnS precipitates when a cast strip subjected to quench solidification is further quenched and held at a high temperature for a short period of time, the $\gamma$ grain grew during the annealing after cold rolling and the final product exhibited good elongation When the cast strip is held at a temperature exceeding 1250° C., since the $\gamma$ grain of the cast strip grows even over a short period of time, roping occurs at the time of cold rolling. Further, good elongation could not be attained when the cast strip was held at a temperature of 900° C. or below for 120 sec. Therefore, in order to produce a thin sheet product excellent in both surface quality and material quality, it is necessary to hold the cast string in a temperature range of from over 900° to 1250° C. for 5 sec to 2 min. It has been found that when the holding time exceeds 2 min, the effect is saturated, while when the holding time is more than 5 sec, the effect can be attained at a temperature of 1000° C. or above.

TABLE 1

Thermal History of Cast Strip and Surface Properties and Workability of Product

| Cast Strip No. | Thermal History of Cast Strip (3.0 mm in thickness) | Properties of Thin Sheet Product: height of roping | Properties of Thin Sheet Product: elongation (%) |
|---|---|---|---|
| (a) | air cooling after casting | 0.8 $\mu$m | 46% |
| (b) | quenching immediately after casting | 0.2 $\mu$m | 46% |
| (c-1) | roll-cooling immediately after casting, holding at 1050° C. for 10 sec | 0.2 $\mu$m | 53% |
| (c-2) | roll-cooling immediately after casting, holding at 1050° C. for 30 sec | 0.2 $\mu$m | 53% |
| (c-3) | roll-cooling immediately after casting, holding at 1050° C. for 60 sec | 0.2 $\mu$m | 54% |

The molten steel is composed mainly of compositions constituting SUS304 steel, and typically comprises, in terms of % by weight, 0.01 to 0.08% of C, 0.25 to 1.50% of Si, 0.15 to 3.0% of Mn, 0.015 to 0.040% of P, 0.001 to 0.020% of S, 16.0 to 28.0% of Cr, 6.0 to 24.0% of Ni, 0.015 to 0.33% of N, 0.01 to 3.0% of Mo and 0.01 to 2.0% of Cu with the balance consisting of Fe and unavoidable impurities. When a more effective prevention of a growth of γ grain of a cast strip is desired, the δ-Fe cal value defined by the formula $$\delta\text{-Fe cal}(\%)=3(Cr+1.5Si+Mo)-2.8(Ni+0.5Cu+0.5Mn)-84(C+N)-19.8$$

is limited to 0% to 10%.

In the present invention, a grain refining element may be added to prevent the growth of the γ grain. Specifically, 0.01 to 1% of one member or 0.01 to 1% in total of at least two members selected from the group consisting of Al, Ti, Nb, Zr, La, Ce and Nd may be added. Alternatively, 0.001% to 1% of one member or 0.001% to 1% in total of at least two members selected from the group consisting of Y, Ca, Mg and B may be added.

The addition of the above described grain refining element in the above described amount to the molten steel enables a fine oxide, nitride, sulfide or carbide to be homogeneously dispersed and precipitated in the molten steel during or after solidification, so that the growth of the γ grain can be remarkably prevented.

Thus, the diameter of the γ grain becomes small, and the roping of the surface of the cold rolled product can be significantly alleviated.

The addition of these refining components, however, prevents the growth of the γ grain during final annealing after cold rolling, gives rise to the refinement of grains and deteriorates the elongation etc. Therefore, in order to improve the workability, it becomes necessary to precipitate these refining elements in the form of an oxide, a nitride, a sulfide or a carbide for rendering the elements non harmful in a temperature range of from over 900° to 1250° C.

Figure 4:
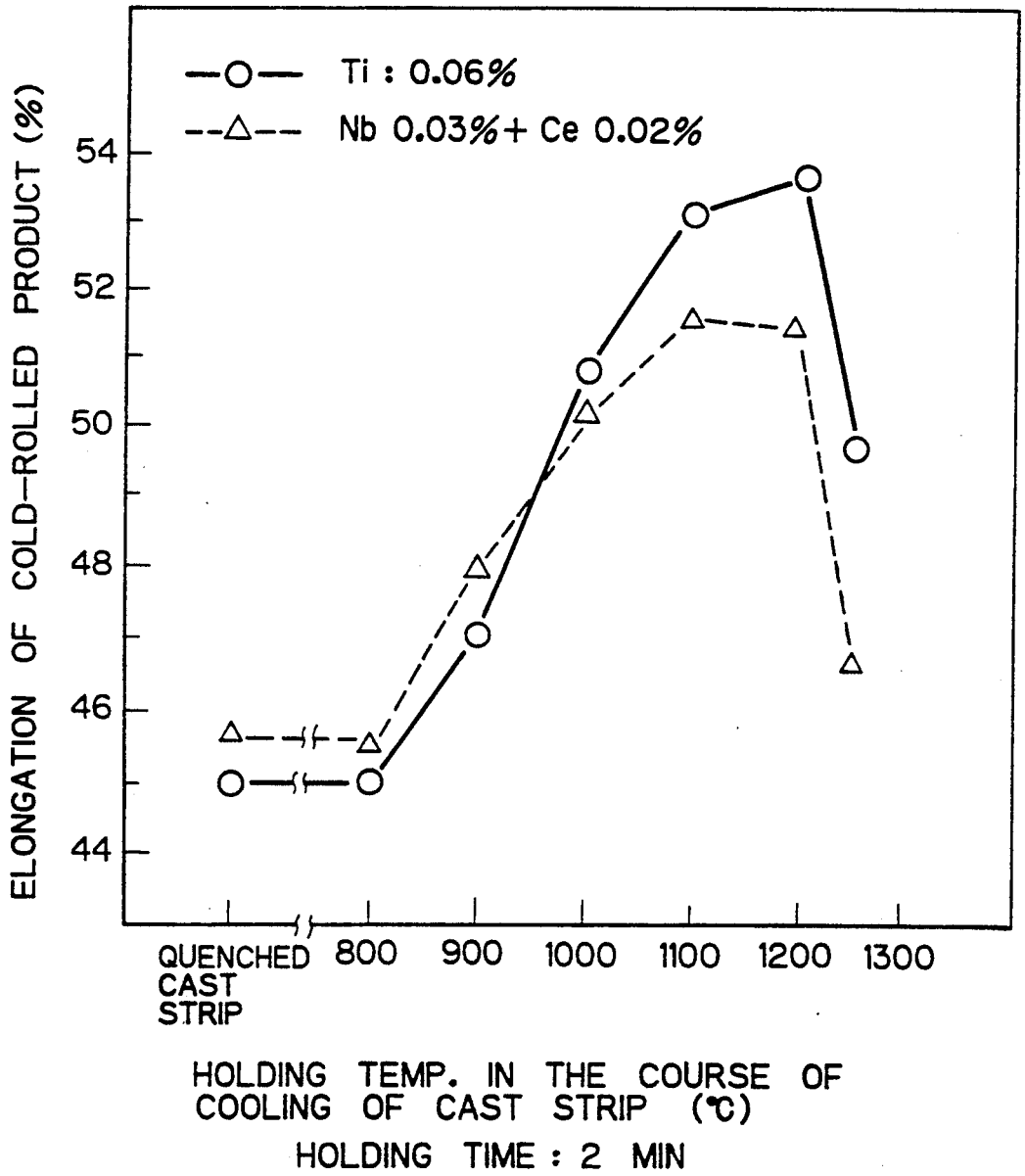
FIG. 4 is a diagram showing the relationship between the holding condition and the elongation of a cold rolled product during the cooling step of a cast strip produced according to the process of the present invention.

FIG. 4 shows the results of a measurement of elongation of a cast strip produced by casting two types of molten steels comprising a 18Cr-8Ni-based austenite stainless steel having a δ-Fe cal value of 4% and, added thereto, 0.06% of Ti or Nb (0.03%)+Ce (0.02%) into a cast strip having a thickness of 3 mm by a twin drum process, cooling the cast strip to 1250° C., holding the strip in a temperature range of from over 900° C. to 1250° C. for 2 min, and subjecting the cast strip to water cooling at a temperature of 900° C. or below.

According to the results, the elongation is poor when a quenched cast strip is cold rolled. On the other hand, in cast strips held in a temperature range of from over 900° to 1250° C. during cooling, elements added in a minor amount including MnS are rendered non harmful, which contributes to an improvement in the elongation.

As shown in FIG. 4, the addition of 0.06% of Ti exhibited substantially the same behavior as that in the case of the addition of 0.03% of Nb+0.02% of Ce.

Thus, the elongation of the product can be improved significantly by rendering the elements added for refining the γ grain non harmful in a temperature range of from over 900° to 1250° C. during cooling after solidification.

Figure 5:
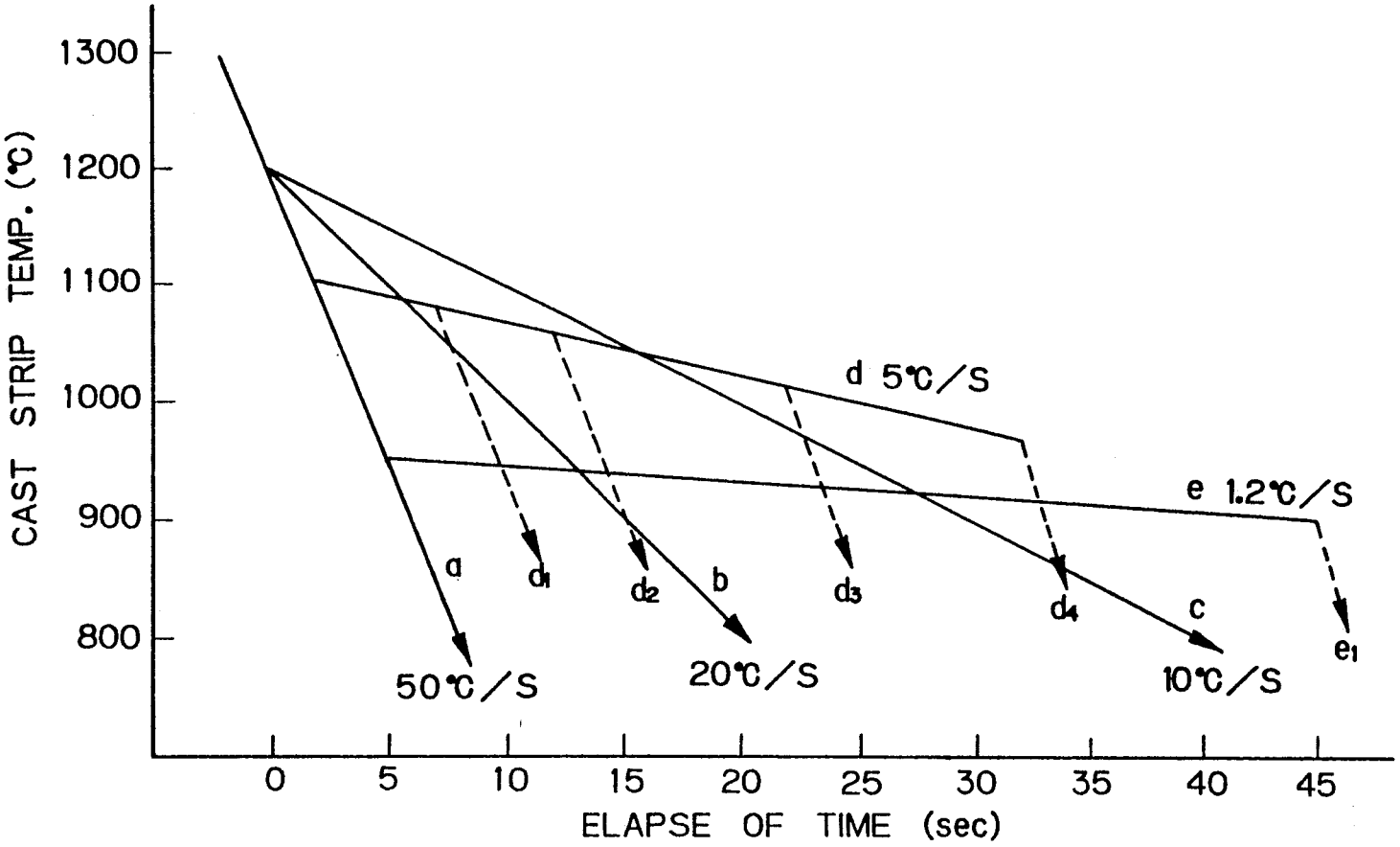
FIG. 5 is a diagram showing a cooling pattern of a cast strip produced according to a synchronous continuous casting process.

Studies conducted by the present inventors have confirmed that an effect comparable to the above-described holding at a constant temperature can be attained when in the course of cooling the cast strip, the cast strip is gradually cooled in a temperature range where coarsening and precipitation of MnS proceed, particularly in a temperature range of from over 950° to 1250° C. at a rate of 20° C./sec or less for 5 sec or more. FIG. 5 is a diagram showing a cooling pattern of a cast strip when a Cr-Ni-based stainless steel represented by 18Cr-8Ni steel is cast by a twin drum process into a strip having a thickness of 3 mm and gradual cooling is initiated at various temperatures in the course of cooling the cast strip.

a represents a cooling pattern of a cast strip quenched from 1200° C. at a rate of 50° C./sec, and b and c are cooling patterns of cast strips gradually cooled from 1200° C. d and e are cooling patterns of cast strips gradually cooled after quenching to 1100° C. and 950° C. In gradual cooling patterns shown in d and e, cooling patterns of cast strips air-cooled for a varied period of times are shown as d1, d2, d3, d4 and e1.

These cast strips were pickled and cold rolled into a sheet having a thickness of 0.6 mm and annealed, and elongation properties of the product were determined. The results are provided in Table 2.

The cast strip subjected to a cooling pattern a exhibited unsatisfactory elongation. The cast strips subjected to cooling patterns b, c and d with gradual cooling exhibited an improved elongation. In particular, the cast strip subjected to a cooling pattern d exhibited an excellent elongation when gradual cooling from a temperature of 1100° C. or less was conducted for 5 sec or more.

In the cast strip subjected to a cooling pattern e, although gradual cooling was conducted from 950° C. at a rate of 1.2° C./sec for 40 sec, elongation was unsatisfactory.

When gradual cooling is initiated from a high temperature exceeding 1050° C., an improvement in elongation can be attained by gradual cooling at a rate of 20° C./sec for 5 sec.

When the initiation temperature of the gradual cooling is 1050° C. or below, the gradual cooling rate capable of improving the elongation decreases with a reduction of the gradual cooling initiation temperature.

Thus, in the present invention, the elongation and surface quality of the cold-rolled product can be improved significantly by conducting a holding or gradual cooling treatment in the course of cooling a cast strip after solidification.

TABLE 2

Cooling Pattern of Cast Strip and Elongation Property of Product

| No. | Thermal History of Cast Strip at the time of Cooling in Temp. Range of from 1200 to 900° C. | | Property of Cold-Rolled Product elongation (%) |
|---|---|---|---|
| a | 50° C./sec | | 46.2% |
| b | 20° C./sec | | 50.9% |
| c | 10° C./sec | | 52.4% |
| d | 1200 to 1100° C. | 50° C./sec | |
| | 1100° C. or less | 5° C./sec × 5 sec d1 | 51.8% |
| | | 5° C./sec × 10 sec d2 | 53.0% |
| | | 5° C./sec × 20 sec d3 | 53.4% |
| | | 5° C./sec × 30 sec d4 (thereafter 50° C./sec) | 53.6% |
| e | 1200 to 950° C. | 50° C./sec | |
| | 950° C. or less | 1.2° C./sec × 40 sec e1 (thereafter 50° C./sec) | 47.8% |

EXAMPLES

EXAMPLE 1

Austenite stainless steels composed mainly of 18Cr-8%Ni steel and further various constituents in Table 3 were produced by a melt process, cast into strips having a thickness of 3 mm by means of an internal water cooling twin drum casting machine, and cooled immediately after casting to 1250° C. by a cooling method such that the cast strip is brought into contact with a main drum by press roll, a roll cooling method or a $N_2$ gas spray cooling method. Then, the cast strips were held in a temperature range of from over 900° to 1250° C. for 2 min or less.

The cast strips were cooled with water from below 900° C. to 600° C. or below, pickled, cold rolled and subjected to bright annealing and temper rolling to provide thin sheet products. The products were subjected to an evaluation of the surface quality and quality of material.

For comparison, thin sheet products were similarly produced from cast strips under conditions cooling immediately after casting and cast strip holding conditions outside the scope of the present invention. These products were subjected to an evaluation of the surface quality and the quality of material.

The results are given in Table 4. It is apparent that the workability can be significantly improved by holding the cast strip in a temperature range of from over 900° to 1250° C. for 2 min or less and the cooling, immediately after solidification to 1250° C., can prevent the occurrence of roping.

Thus, the thin sheets produced according to the process of the present invention (Nos. 1 to 9) had an excellent workability and a good surface quality, while the thin sheets produced according to the comparative process (Nos. 10 to 12) were poor in material quality (elongation) and surface quality (roping).

TABLE 3

| | (wt. %) | | | | | | | | | | | |
|---|---|---|---|---|---|---|---|---|---|---|---|---|
| No. | C | Si | Mn | P | S | Cr | Ni | Mo | Cu | Al | N | O |
| 1 | 0.051 | 0.50 | 0.93 | 0.027 | 0.003 | 18.23 | 8.79 | 0.09 | 0.10 | 0.003 | 0.0302 | 0.0057 |
| 2 | 0.060 | 0.50 | 0.94 | 0.016 | 0.004 | 18.21 | 8.88 | 0.09 | 0.13 | 0.003 | 0.0327 | 0.0069 |
| 3 | 0.053 | 0.48 | 1.01 | 0.018 | 0.001 | 18.31 | 8.68 | 0.01 | 0.07 | 0.003 | 0.0323 | 0.0054 |
| 4 | 0.051 | 0.50 | 0.98 | 0.024 | 0.008 | 18.25 | 8.79 | 0.29 | 0.09 | 0.003 | 0.0304 | 0.0148 |
| 5 | 0.055 | 0.48 | 1.00 | 0.024 | 0.005 | 18.03 | 8.75 | 0.12 | 0.11 | 0.002 | 0.0281 | 0.0025 |
| 6 | 0.050 | 0.49 | 0.98 | 0.014 | 0.002 | 18.24 | 8.67 | 0.13 | 0.12 | 0.003 | 0.0305 | 0.0043 |
| 7 | 0.050 | 0.62 | 1.35 | 0.016 | 0.004 | 22.60 | 13.90 | 0.13 | 0.01 | 0.002 | 0.0281 | 0.0065 |
| 8 | 0.060 | 0.60 | 1.01 | 0.032 | 0.002 | 17.63 | 12.32 | 2.30 | 0.25 | 0.003 | 0.0120 | 0.0096 |
| 9 | 0.030 | 0.60 | 0.90 | 0.030 | 0.003 | 18.30 | 8.40 | 0.16 | 0.21 | 0.002 | 0.0328 | 0.0052 |
| 10 | 0.069 | 0.50 | 0.98 | 0.028 | 0.008 | 18.10 | 10.20 | 0.01 | 0.08 | 0.003 | 0.0306 | 0.0049 |
| 11 | 0.052 | 0.50 | 0.97 | 0.030 | 0.004 | 18.22 | 9.93 | 0.16 | 0.09 | 0.002 | 0.0282 | 0.0065 |
| 12 | 0.061 | 0.50 | 0.94 | 0.030 | 0.003 | 18.43 | 8.67 | 0.16 | 0.21 | 0.002 | 0.0159 | 0.0061 |

TABLE 4

| Classification | No. | Thickness of Cast Strip (mm) | Casting Atmosphere | Cooling from Immediately after Solidification to 1250° C. | Conditions for Holding in Temp. Range of from over 900 to 1250° C. | Cold Draft (%) | Properties of Product surface(1) | Properties of Product workability(2) |
|---|---|---|---|---|---|---|---|---|
| Process of Present Invention | 1 | 2.5 | $N_2 + O_2$ | press rolling (400° C./sec) | 1050° C. × 15 sec | 75 | ○ | ○ |
| | 2 | 2.3 | $N_2$ | press rolling (400° C./sec) | 1050° C. × 30 sec | " | ○ | ○ |
| | 3 | 2.3 | $N_2$ | press rolling (400° C./sec) | 1050° C. × 100 sec | " | ○ | ○ |
| | 4 | 2.3 | $N_2 + O_2 + Ar$ | press rolling (400° C./sec) | 1050° C. × 20 sec | " | ○ | ○ |
| | 5 | 5.8 | $N_2 + O_2 + Ar$ | press rolling (300° C./sec) | " | 85 | ○ | ○ |
| | 6 | 4.1 | $N_2 + Ar$ | roll cooling (200° C./sec) | 1100° C. × 7 sec | 80 | ○ | ○ |
| | 7 | 3.4 | $N_2 + Ar$ | roll cooling (200° C./sec) | " | 70 | ○ | ○ |
| | 8 | 2.3 | $N_2$ | roll cooling (200° C./sec) | " | 70 | ○ | ○ |
| | 9 | 2.3 | $N_2$ | $N_2$ gas cooling (150° C./sec) | 1000° C. × 30 sec | 50 | ○ | ○ |
| Comp. Process | 10 | 2.3 | $N_2$ | none (80° C./sec) | 1000° C. × 15 sec | 65 | X | X |
| | 11 | 2.3 | Ar | none (80° C./sec) | none | 65 | X | X |
| | 12 | 2.1 | $N_2$ | none (80° C./sec) | none | 65 | X | X |

Note)
(1) "Surface" is an evaluation on occurrence of roping.
○ : free from roping
X: significant occurrence of roping
(2) "Workability" is an elongation in the L direction.
○ : good elongation
X: poor elongation

EXAMPLE 2

Austenite stainless steels composed mainly of 18%Cr-8%Ni steel and further various constituents in Table 3 were produced by a melt process, cast into strips having a thickness of 2 mm in various atmospheres by means of an internal water cooling twin drum casting machine, and held in a temperature range of from over 900° to 1250° C. The cast strips were cooled with water from below 900° C. to 600° C. or below. Thereafter, they were pickled, cold rolled and subjected to annealing and temper rolling to provide thin sheet products. The products were subjected to an evaluation of the surface quality and quality of material.

For comparison, thin sheet products were similarly produced from cast strips under heat treatment conditions immediately after casting, and δ-Fe cal and casting atmosphere conditions outside the scope of the present invention. These products were subjected to an evaluation of the surface quality and the quality of material.

The results are given in Table 5. From Table 5, it is apparent that the thin sheets produced according to the process of the present invention (Nos. 13 to 21) were excellent in the material quality and surface quality, while the thin sheets produced according to the comparative process (Nos. 22 to 24) were poor in material quality (elongation) and surface quality (roping).

TABLE 5

| Classification | No. | δ-Fe cal (%) | Thickness of Cast Strip (mm) | Casting Atmosphere | Conditions for Holding in Temp. Range of from over 900 to 1250° C. | Reduction Ratio of Cold Rolling (%) | Properties of Product surface(1) | Properties of Product workability(2) |
|---|---|---|---|---|---|---|---|---|
| Process of Present Invention | 13 | 4.56 | 2.5 | $N_2$ | 1100° C. × 10 sec | 50 | ○ | ○ |
| | 14 | 3.22 | 2.3 | $N_2$ | 1100° C. × 10 sec | 50 | ○ | ○ |
| | 15 | 4.36 | 2.3 | $N_2$ | 1100° C. × 10 sec | 50 | ○ | ○ |
| | 16 | 5.14 | 2.3 | $N_2 + O_2$ | 1200° C. × 5 sec | 80 | ○ | ○ |
| | 17 | 3.79 | 5.8 | $N_2$ | 1200° C. × 20 sec | 80 | ○ | ○ |
| | 18 | 4.96 | 4.1 | $N_2$ + Ar | 1200° C. × 40 sec | 80 | ○ | ○ |
| | 19 | 3.81 | 3.4 | $N_2$ | 1050° C. × 8 sec | 50 | ○ | ○ |
| | 20 | 0.40 | 2.3 | He + Ar | 1050° C. × 15 sec | 60 | ○ | ○ |
| | 21 | 7.95 | 2.3 | $N_2$ | 950° C. × 80 sec | 85 | ○ | ○ |
| Comp. Process | 22 | −1.16 | 2.3 | $N_2$ | 950° C. × 80 sec | 65 | X | ○ |
| | 23 | 1.58 | 2.3 | Ar | 950° C. × 80 sec | 65 | ○ | X |
| | 24 | 4.69 | 2.1 | $N_2$ | none | 65 | X | ○ |

Note)
(1) "Surface" is an evaluation on occurrence of roping.
○ : free from roping
X: significant occurrence of roping
(2) "Workability" is an elongation in the L direction.
○ : good elongation
X: poor elongation

EXAMPLE 3

A Cr-Ni-based stainless steel having a basic compositions of 18%Cr-8%Ni represented in Table 6 and produced by the conventional melt process was cast by an internal water cooling twin drum process into cast strips respectively having thicknesses of 3 mm and 4 mm. In a high temperature region immediately behind the outlet of the twin drum casting machine, cooling was conducted by roll cooling instead of air cooling. The cast strips were held in a temperature range of from over 900° to 1250° C. for 9 to 110 sec, cooled with water from below 900° C. to 600° C. at an average cooling rate of 10° C./sec or more and wound at a temperature of 600° C. or below.

TABLE 6

| Cast Strip | Thickness of Cast Strip | C | Si | Mn | P | S | Cr | Ni | Mo | Cu | N |
|---|---|---|---|---|---|---|---|---|---|---|---|
| | | Chemical Compositions (wt. %) | | | | | | | | | |
| 25 | 3 mm | 0.03 | 0.60 | 1.10 | 0.022 | 0.004 | 18.3 | 8.6 | 0.12 | 0.15 | 0.032 |
| 26 | 4 mm | 0.04 | 0.55 | 1.00 | 0.026 | 0.002 | 18.4 | 8.4 | 0.11 | 0.08 | 0.025 |

Thereafter, the cast strips were descaled by mechanical descaling and pickling and subjected to preliminary cold rolling. Both the cast strips respectively having thicknesses of 3 mm and 4 mm were preliminarily cold rolled with a draft in the range of from 30 to 50%, annealed at 1000° C. for 20 sec or less and then quenched.

Thus, the cast strips were recrystallized. Thereafter, they were subjected to main cold rolling to a thickness of 0.6 mm, and the final annealing was conducted according to the conventional procedure to provide products 2B and BA that were then subjected to temper rolling. Properties of the products thus obtained are provide in Table 7. These products were excellent in both surface properties and mechanical properties.

The comparative process was the same as the process of the present invention, except that use was made of cast strips subjected to air cooling in a temperature range of from over 900° to 1250° C. Although the resultant products had improved surface properties, they were inferior in elongation and workability.

TABLE 7

| Classification | Cast Strip No. | Thermal History of Cast Strip: solidification to high temp. | Thermal History of Cast Strip: cooling rate in temp. range of from 900 to 600° C. | Classification of Product | Quality of Thin Sheet Product: roping | Quality of Thin Sheet Product: elongation (%) |
|---|---|---|---|---|---|---|
| Process of Present Invention | 25: 3 mm in thickness | casting → roll cooling → holding at 1130° C. × 10 sec | 20° C./sec | 2B | 0.2 μm or less | 51.8 |
| | | casting → roll cooling → holding at 1080° C. × 20 sec | 20° C./sec | 2B | 0.2 μm or less | 52.2 |
| | | casting → roll cooling → holding at 1050° C. × 50 sec | 20° C./sec | 2B | 0.2 μm or less | 52.4 |
| | | casting → roll cooling → holding at 1010° C. × 80 sec | 20° C./sec | 2B | 0.2 μm or less | 53.0 |
| | 26: 4 mm | casting → roll cooling → holding at 1090° C. × 9 sec | 20° C./sec | BA | 0.2 μm or less | 52.4 |

TABLE 7-continued

| Classification | Cast Strip No. | Thermal History of Cast Strip: solidification to high temp. | cooling rate in temp. range of from 900 to 600° C. | Classification of Product | Quality of Thin Sheet Product: roping | elongation (%) |
|---|---|---|---|---|---|---|
| | in thickness | casting → roll cooling → holding at 1050° C. × 110 sec | 20° C./sec | BA | 0.2 μm or less | 54.3 |
| | | casting → roll cooling → holding at 980° C. × 100 sec | 20° C./sec | BA | 0.2 μm or less | 53.8 |
| Comp. Process | 27: 3 mm in thickness | casting → air cooling | 20° C./sec | 2B | 0.2 μm or less | 47.9 |
| | 28: 4 mm in thickness | casting → air cooling | 20° C./sec | BA | 0.2 μm or less | 48.0 |

Thin sheet production process:
Cast strip-Mechanical-descaling-Pickling-Preliminary Cold Rolling (30-50%)-1000° C. intermediate annealing-Pickling-Cold Rolling (0.6 mm)-FAP or FBA → Temper rolling

EXAMPLE 4

Austenite stainless steels composed mainly of 18Cr-8Ni steel and various constituents in Tables 8 (1) and (2) were produced by a melt process.

The δ-Fe cal (%) varied in the range of from 0 to 10%, and 0.01 to 0.9% of one member or 0.1 to 0.9% in total of at least two members selected from the group consisting of Al, Ti, Nb, Zr, La, Ce and Nd or 0.001 to 0.9% of one member of 0.001 to 0.9% in total of at least two members selected from the group consisting of Y, Mg, Ca and B was added as a crystal grain refining element.

These molten steels were continuously cast by means of an internal water cooling twin roll continuous casting machine into cast strips having a thickness of 1 to 6 mm and a width of 1000 mm, which were quenched by a method wherein the solidified cast strips were pressed against a water cooling drum from the output of the twin roll. In this case, the average rate of cooling to 1250° C. was 50° C./sec or more.

The holding in a temperature range of form 1250 to 900° C. exclusive was conducted under the following three conditions.

(a) holding at 1100° C. for 20 sec→air cooling to 900° C. →water cooling from 900° to 550° C.→coiling at 550° C.

(c) coiling at 1000° C.→gradual coiling→solution heat treatment at 1100° C.

Thereafter, they were pickled, cold-rolled and subjected to a series of conventional treatments to provide products 2B and BA. The results are provided in Tables 3 and 4 together with cast strip production conditions.

In cast strips produced according to the process of the present invention wherein δ solidification was utilized, refining elements were incorporated and holding was conducted in the course of cooling of the cast strip under conditions capable of rendering these refining elements non-harmful; the products exhibited significantly improved mechanical properties, e.g., elongation and surface quality, e.g., roping free.

In the comparative process, mechanical properties (elongation) and surface properties (roping) were both poor because no refining element was incorporated or δ solidification was utilized and cast strip holding conditions were not satisfied.

TABLE 8

(wt. %)

| No. | C | S | Mn | P | S | Cu | Ni | Cr | Mo | Al | Ti | Ce | Nd |
|---|---|---|---|---|---|---|---|---|---|---|---|---|---|
| 31 | 0.045 | 0.50 | 1.08 | 0.011 | 0.004 | 0.19 | 10.45 | 18.07 | 0.01 | 0.353 | 0 | 0 | 0 |
| 32 | 0.060 | 0.58 | 0.99 | 0.030 | 0.003 | 0.02 | 9.04 | 18.79 | 0.01 | 0.004 | 0 | 0.161 | 0 |
| 33 | 0.060 | 0.58 | 0.98 | 0.031 | 0.003 | 0.02 | 9.40 | 18.82 | 0.01 | 0.004 | 0 | 0 | 0 |
| 34 | 0.060 | 0.56 | 0.98 | 0.030 | 0.003 | 0.02 | 8.29 | 18.94 | 0.02 | 0.004 | 0 | 0 | 0 |
| 35 | 0.070 | 0.61 | 0.99 | 0.030 | 0.003 | 0.02 | 10.13 | 18.81 | 0.01 | 0.004 | 0.115 | 0 | 0 |
| 36 | 0.060 | 0.61 | 1.00 | 0.029 | 0.003 | 0.02 | 10.45 | 18.80 | 0.01 | 0.004 | 0 | 0 | 0 |
| 37 | 0.064 | 0.61 | 1.00 | 0.031 | 0.005 | 0.01 | 8.02 | 18.93 | 0 | 0.001 | 0 | 0 | 0 |
| 38 | 0.064 | 0.65 | 0.80 | 0.030 | 0.004 | 0.02 | 8.86 | 18.53 | 0.01 | 0.002 | 0 | 0 | 0 |
| 39 | 0.060 | 0.49 | 0.80 | 0.030 | 0.004 | 0.02 | 9.54 | 18.50 | 0.01 | 0.002 | 0 | 0 | 0 |
| 40 | 0.064 | 0.49 | 0.80 | 0.030 | 0.004 | 0.02 | 9.83 | 18.51 | 0.02 | 0.002 | 0 | 0 | 0 |
| 41 | 0.066 | 0.65 | 0.80 | 0.030 | 0.004 | 0.02 | 8.70 | 18.50 | 0.01 | 0.002 | 0 | 0.021 | 0 |
| 42 | 0.061 | 0.49 | 0.80 | 0.030 | 0.004 | 0.02 | 9.44 | 18.50 | 0 | 0.002 | 0 | 0 | 0 |
| 43 | 0.064 | 0.49 | 0.80 | 0.030 | 0.004 | 0.02 | 8.02 | 19.50 | 0.02 | 0.002 | 0 | 0 | 0 |
| 44 | 0.066 | 0.49 | 0.81 | 0.028 | 0.004 | 0.02 | 10.07 | 18.10 | 0.01 | 0.020 | 0.081 | 0.092 | 0 |
| 45 | 0.042 | 0.49 | 0.81 | 0.029 | 0.004 | 0.02 | 10.37 | 18.14 | 0.01 | 0.002 | 0 | 0.061 | 0.033 |
| 46 | 0.031 | 0.49 | 0.80 | 0.030 | 0.004 | 0.02 | 10.77 | 18.07 | 0.01 | 0.002 | 0.021 | 0 | 0 |
| 47 | 0.066 | 0.49 | 0.80 | 0.030 | 0.004 | 0.02 | 8.77 | 18.07 | 0.03 | 0.002 | 0.01 | 0.021 | 0 |
| 48 | 0.066 | 0.49 | 0.80 | 0.031 | 0.004 | 0.02 | 8.77 | 18.07 | 0.03 | 0.010 | 0 | 0 | 0 |
| 49 | 0.055 | 0.50 | 0.84 | 0.029 | 0.004 | 0.02 | 8.14 | 18.95 | 0.03 | 0.004 | 0 | 0 | 0 |
| 50 | 0.052 | 0.50 | 0.84 | 0.028 | 0.004 | 0.02 | 8.56 | 18.42 | 0.01 | 0.003 | 0 | 0 | 0 |
| 51 | 0.051 | 0.49 | 0.83 | 0.029 | 0.004 | 0.02 | 10.42 | 17.97 | 0.01 | 0.003 | 0 | 0 | 0 |
| 52 | 0.060 | 0.45 | 0.78 | 0.029 | 0.003 | 0.02 | 11.19 | 18.05 | 0.01 | 0.003 | 0.12 | 0 | 0 |
| 53 | 0.064 | 0.50 | 0.88 | 0.030 | 0.004 | 0.01 | 10.93 | 18.35 | 0.01 | 0.002 | 0 | 0.054 | 0 |

TABLE 8-continued

| | (wt. %) | | | | | | | | | |
|---|---|---|---|---|---|---|---|---|---|---|
| No. | La | Zr | Nb | Mg | Ca | Y | B | N | O | δ - Fe cal |
| 31 | 0 | 0 | 0 | 0 | 0 | 0 | 0 | 0.0201 | 0.0100 | 0.18 |
| 32 | 0 | 0 | 0 | 0 | 0 | 0 | 0 | 0.0178 | 0.0097 | 5.95 |
| 33 | 0.181 | 0 | 0 | 0 | 0 | 0 | 0 | 0.0174 | 0.0102 | 5.08 |
| 34 | 0 | 0 | 0.32 | 0 | 0 | 0 | 0 | 0.0188 | 0.0100 | 8.37 |
| 35 | 0 | 0 | 0 | 0 | 0 | 0 | 0 | 0.0218 | 0.0101 | 3.64 |
| 36 | 0 | 0.098 | 0 | 0 | 0 | 0 | 0 | 0.0225 | 0.0136 | 1.76 |
| 37 | 0 | 0 | 0 | 0.049 | 0 | 0 | 0 | 0.0125 | 0.0101 | 9.44 |
| 38 | 0 | 0 | 0 | 0 | 0 | 0.234 | 0 | 0.0300 | 0.0101 | 4.89 |
| 39 | 0 | 0 | 0 | 0 | 0.128 | 0 | 0 | 0.0300 | 0.0100 | 2.52 |
| 40 | 0 | 0.121 | 0.031 | 0 | 0 | 0 | 0 | 0.0300 | 0.0100 | 1.43 |
| 41 | 0.041 | 0 | 0 | 0 | 0 | 0 | 0 | 0.0300 | 0.0101 | 5.08 |
| 42 | 0.05 | 0 | 0.081 | 0 | 0 | 0 | 0 | 0.0300 | 0.0100 | 2.68 |
| 43 | 0 | 0.121 | 0.031 | 0 | 0.023 | 0 | 0 | 0.0300 | 0.0100 | 9.47 |
| 44 | 0 | 0 | 0 | 0 | 0 | 0 | 0 | 0.0300 | 0.0097 | 0.53 |
| 45 | 0.034 | 0 | 0 | 0 | 0 | 0.111 | 0 | 0.0300 | 0.0098 | 0.61 |
| 46 | 0 | 0.119 | 0.092 | 0 | 0 | 0 | 0 | 0.0300 | 0.0083 | 0.22 |
| 47 | 0.084 | 0.009 | 0 | 0 | 0 | 0 | 0 | 0.0300 | 0.0083 | 3.09 |
| 48 | 0 | 0 | 0 | 0 | 0 | 0 | 0.003 | 0.0300 | 0.0081 | 3.09 |
| 49 | 0 | 0 | 0 | 0 | 0 | 0 | 0 | 0.0201 | 0.0156 | 9.09 |
| 50 | 0 | 0 | 0 | 0 | 0 | 0 | 0 | 0.0273 | 0.0025 | 5.91 |
| 51 | 0 | 0 | 0 | 0 | 0 | 0 | 0 | 0.0256 | 0.0019 | −0.46 |
| 52 | 0 | 0 | 0 | 0 | 0 | 0 | 0 | 0.0402 | 0.0150 | −3.74 |
| 53 | 0 | 0 | 0 | 0 | 0 | 0 | 0 | 0.0350 | 0.0120 | −2.64 |

TABLE 9

| | No. | Thickness of Cast Strip (mm) | Condition for Holding Cast Strip | Reduction Ratio of Cold Rolling (%) | Thickness of Product (mm) | Elongation of Product Sheet | | Height of Roping (μm) | |
|---|---|---|---|---|---|---|---|---|---|
| | | | | | | Product 2B | Product BA | Product 2B | Product BA |
| Process of Present Invention | 31 | 1.1 | b | 50 | 0.55 | 52.2 | 51.9 | ≦0.2 | ≦0.2 |
| | | | | 85 | 0.17 | 52.4 | 51.9 | " | " |
| | 32 | 3.8 | a | 50 | 1.90 | 53.1 | 52.7 | " | " |
| | | | | 85 | 0.57 | 52.8 | 52.6 | " | " |
| | 33 | 5.3 | a | 50 | 2.65 | 50.6 | 50.5 | " | " |
| | | | | 85 | 0.80 | 51.8 | 51.9 | " | " |
| | 34 | 2.4 | c | 50 | 1.20 | 54.4 | 54.2 | " | " |
| | | | | 85 | 0.36 | 53.9 | 54.2 | " | " |
| | 35 | 5.7 | a | 50 | 2.85 | 51.6 | 52.2 | " | " |
| | | | | 85 | 0.86 | 52.3 | 53.3 | " | " |
| | 36 | 2.3 | a | 50 | 1.15 | 53.3 | 52.9 | " | " |
| | | | | 85 | 0.35 | 53.8 | 53.1 | " | " |
| | 37 | 1.0 | b | 50 | 0.50 | 52.2 | 52.6 | " | " |
| | | | | 85 | 0.15 | 52.4 | 52.6 | " | " |
| | 38 | 3.3 | a | 50 | 1.65 | 54.4 | 53.6 | " | " |
| | | | | 85 | 0.50 | 54.3 | 53.8 | " | " |
| | 39 | 4.1 | b | 50 | 2.05 | 53.8 | 53.2 | " | " |
| | | | | 85 | 0.62 | 53.4 | 53.3 | " | " |
| | 40 | 2.3 | c | 50 | 1.15 | 54.7 | 54.1 | " | " |
| | | | | 85 | 0.35 | 54.8 | 54.2 | " | " |
| | 41 | 2.1 | a | 50 | 1.05 | 53.4 | 52.9 | " | " |
| | | | | 85 | 0.32 | 53.6 | 53.1 | " | " |
| | 42 | 1.8 | b | 50 | 0.90 | 53.3 | 52.9 | " | " |
| | | | | 85 | 0.27 | 53.6 | 52.7 | " | " |
| | 43 | 3.7 | b | 50 | 1.85 | 52.6 | 52.4 | " | " |
| | | | | 85 | 0.56 | 52.8 | 52.5 | " | " |
| | 44 | 9.3 | a | 50 | 4.65 | 54.3 | 52.6 | " | " |
| | | | | 85 | 1.40 | 54.9 | 52.7 | " | " |
| | 45 | 2.1 | b | 50 | 1.05 | 52.6 | 51.9 | " | " |
| | | | | 85 | 0.32 | 52.6 | 53.1 | " | " |
| | 46 | 2.2 | c | 50 | 1.10 | 55.3 | 54.6 | " | " |
| | | | | 85 | 0.33 | 55.1 | 54.7 | 0.15 | 0.15 |
| | 47 | 3.1 | b | 50 | 1.55 | 54.4 | 54.2 | ≦0.2 | ≦0.2 |
| | | | | 85 | 0.47 | 53.8 | 54.0 | " | " |
| | 48 | 3.1 | a | 50 | 1.55 | 52.9 | 53.1 | " | " |
| | | | | 85 | 0.47 | 52.8 | 53.0 | " | " |
| Comp. Process | 49 | 1.2 | No holding → quenching → coiling at 550° C. | 50 | 0.60 | 44.2 | 44.8 | 0.4 | 0.4 |
| | | | | 85 | 0.18 | 45.1 | 44.7 | 0.3 | 0.3 |
| | 50 | 3.1 | No holding → quenching → coiling at 550° C. | 50 | 1.52 | 45.0 | 44.1 | 0.5 | 0.5 |
| | | | | 85 | 0.47 | 45.1 | 44.2 | 0.3 | 0.3 |
| | 51 | 2.5 | No holding → quenching → coiling at 550° C. | 50 | 1.25 | 44.9 | 45.0 | 0.8 | 0.8 |
| | | | | 85 | 0.38 | 44.9 | 45.0 | 0.4 | 0.4 |
| | 52 | 4.8 | No holding → quenching → coiling at 550° C. | 50 | 2.40 | 45.0 | 44.6 | 0.4 | 0.4 |
| | | | | 85 | 0.72 | 45.1 | 44.8 | 0.3 | 0.3 |

TABLE 9-continued

| No. | Thickness of Cast Strip (mm) | Condition for Holding Cast Strip | Reduction Ratio of Cold Rolling (%) | Thickness of Product (mm) | Elongation of Product Sheet | | Height of Roping (μm) | |
|---|---|---|---|---|---|---|---|---|
| | | | | | Product 2B | Product BA | Product 2B | Product BA |
| 53 | 5.6 | No holding → quenching → coiling at 550° C. | 50 | 2.80 | 45.2 | 44.2 | 0.4 | 0.4 |
| | | | 85 | 0.84 | 45.4 | 44.9 | 0.3 | 0.3 |

Note)
Conditions for holding cast strip
a: holding at 1100° C. × 20 sec → air cooling → water cooling at 900° C. or below → coiling at 550° C.
b: holding at 1050° C. × 100 sec → air cooling → water cooling at 900° C. or below → coiling at 550° C.
c: holding at 1000° C. → gradual cooling → solution heat coiling at 1100° C.

EXAMPLE 5

Austenite stainless steels having a basic composition of 18%Cr-8%Ni and various constituents in Table 3 were produced by a melting process and cast into strips having a thickness of 2 to 5.8 mm in various atmospheres by means of an internal water cooling twin drum casting machine. The cast strips were passed through a combustion furnace with varied temperatures. Thus, the cast strips were subjected to gradual cooling from various temperatures between 1200° C. and 900° C. for 2 min or less, cooled in a temperature range of from 900° to 600° C. at a rate of 10° C./sec and coiled at a temperature of 600° C. or below.

Thereafter, the cast strips were subjected to pickling, cold rolling, bright annealing and temper rolling to provide thin sheet products that were then subjected to an evaluation of the quality of material.

For comparison, thin sheet products were similarly produced also from cast strips under varied conditions of cooling rate and cooling time immediately after casting and then subjected to an evaluation of the quality of material.

The results are given in Table 10.

The steels of the present invention wherein gradual cooling was initiated in a temperature range of rom 1150° to 1000° C. and conducted at a rate of 0.8 to 20° C./sec or 20° C./sec or less for a time period of 5 to 110 sec and then cooled in a temperature range of from 900° to 600° C. at a rate of 10° C./sec or more and exhibited improved workability (elongation).

On the other hand, in the comparative process, since no gradual cooling was performed, workability was poor.

TABLE 10

| Classification | No. | δ-Fe cal (%) | Thickness of Cast Strip (mm) | Casting Atmosphere | Moderate Cooling Initiation Temp. | Conditions for Moderate Cooling: cooling rate | Conditions for Moderate Cooling: moderate cooling time | Rate of Cooling in Temp. Range of from 900 to 600° C. | Reduction Ratio of Cold Rolling (%) | Properties of Product: surface (1) | Properties of Product: workability (2) |
|---|---|---|---|---|---|---|---|---|---|---|---|
| Process of Present Invention | 54 | 4.56 | 2.5 | $N_2$ | 1150° C. | 3° C./s | 5 sec | 20° C./s | 70 | ○ | ○ |
| | 55 | 3.22 | 2.3 | $N_2$ | 1150° C. | 10° C./s | 7 sec | 20° C./s | 65 | ○ | ○ |
| | 56 | 7.72 | 2.3 | $N_2$ | 1150° C. | 20° C./s | 20 sec | 20° C./s | 65 | ○ | ○ |
| | 57 | 5.14 | 2.3 | $N_2 + O_2$ | 1100° C. | 5° C./s | 6 sec | 20° C./s | 65 | ○ | ○ |
| | 58 | 6.31 | 5.8 | $N_2$ | 1100° C. | 15° C./s | 10 sec | 15° C./s | 90 | ○ | ○ |
| | 59 | 4.96 | 4.1 | $N_2 + Ar$ | 1100° C. | 18° C./s | 20 sec | 15° C./s | 85 | ○ | ○ |
| | 60 | 3.81 | 3.4 | $N_2$ | 1050° C. | 2° C./s | 9 sec | 20° C./s | 80 | ○ | ○ |
| | 61 | 0.40 | 2.3 | $He + Ar$ | 1050° C. | 1° C./s | 10 sec | 20° C./s | 65 | ○ | ○ |
| | 62 | 7.95 | 2.3 | $N_2$ | 1000° C. | 0.8° C./s | 110 sec | 20° C./s | 65 | ○ | ○ |
| Comp. Process | 63 | −1.16 | 2.3 | $N_2$ | 1250° C. | 80° C./s | 4 sec | 20° C./s | 65 | X | X |
| | 64 | 1.58 | 2.3 | Ar | 1200° C. | 50° C./s | 5 sec | 20° C./s | 65 | X | X |
| | 65 | 4.69 | 2.1 | $N_2$ | 1150° C. | 50° C./s | 5 sec | 20° C./s | 65 | X | ○ |

Note)
(1) "Surface" is an evaluation on occurrence of roping.
○ : free from roping
X: significant occurrence of roping
(2) "Workability" is an elongation in the L direction.
○ : good elongation
X: poor elongation

We claim:

1. A process for producing a thin sheet of a Cr-Ni-based stainless steel represented by 18%Cr-8%Ni steel having excellent surface quality and workability, comprising the steps of:

pouring said stainless steel in a molten state into a mold of a continuous casting machine having a mold wall surface that moves in synchronization with a cast strip and effecting rapid solidification at a cooling rate of 100° C./sec or more to continuously cast a cast strip having a thickness of 10 mm or less;

cooling the resultant cast strip after solidification to 1250° C. at a cooling rate of 100° C./sec or more and preventing the occurrence of recuperation;

holding the cooled cast strip in a temperature range of from over 900° to 1250° C. for 5 sec to 2 min; and cooling and coiling the cast strip and subjecting the cast strip to annealing, pickling, cold rolling and annealing to provide a final product.

2. A process according to claim 1, wherein after the holding, the cast strip is cooled in a temperature range of from 600° to 900° C. at an average cooling rate 10° C./sec or more, coiled at a temperature of 600° C. or below and subjected to pickling, cold rolling and annealing without annealing the cast strip to provide a final product.

3. A process according to claim 1, wherein the cast strip produced by cooling at a rate of 100° C./sec or more after solidification has such a structure that MnS having a grain diameter of 0.05 μm or less is homogeneously dispersed and precipitated.

4. A process according to claim 1, wherein the cast strip after holding has such a structure that MnS having a grain diameter of 0.5 to 1 μm is dispersed and precipitated.

5. A process according to claim 1, wherein δ-Fe cal (%) of ingredients of said Cr-Ni-based stainless steel defined by the following formula is regulated to 0% to 10%:

$$\delta\text{-Fe cal}(\%)=3(Cr+1.5Si+Mo)-2.8(Ni+0.5Mn+0.5Cu)-84(C+N)-19.8(\%).$$

6. A process according to claim 1, wherein the molten steel is cast in an atmosphere composed mainly of $N_2$ or He.

7. A process according to claim 1 or 5, wherein 0.01 to 1% of one member or 0.01 to 1% in total of at least two members selected from the group consisting of Al, Ti, Nb, Zr, La, Ce and Nd or 0.001 to 1% of one member or 0.001% to 1% in total of at least two members selected from the group consisting of Mg, Ca and B is added to said molten steel.

8. A process according to claim 1, wherein the cast strip is held at a constant temperature in the range o from over 900° to 1250° C. for 5 sec to 2 min.

9. A process according to claim 1, wherein the thickness of the cast strip is 6 mm or less.

10. A process according to claim 1, wherein the cast strip is held, cooled to below 900° C., coiled, annealed, pickled, subjected to preliminary cold rolling with a reduction ratio of 60% or less, annealed at a temperature of 850° C. or above for recrystallization to bring the average grain diameter of γ grain to 50 μm or less, pickled, cold rolled to a final sheet thickness, subjected to final annealing and pickled or subjected to bright annealing and then subjected to temper rolling.

11. A process for producing a thin sheet of a Cr-Ni-based stainless steel represented by 18%Cr-8%Ni steel having excellent surface quality and workability, comprising the steps of:

pouring a molten steel of said Cr-Ni-based stainless steel having δ-Fe cal (%) of the ingredients pouring a molten steel of said Cr-Ni-based stainless steel having δ-Fe cal (%) of the ingredients regulated to 0% to 10% into a mold of a continuous casting machine having a mold wall surface that moves in synchronization with a cast strip and effecting rapid solidification at a cooling rate of 100° C./sec or more to continuously cast a cast strip having a thickness of 10 mm or less;

cooling the resultant cast strip after solidification to 1250° C. at a cooling rate of 100° C./sec or more and preventing the occurrence of recuperation;

holding the cooled cast strip in a temperature range of from over 900° to 1250° C. for 5 sec to 2 min; and cooling and coiling the cast strip and subjecting the cast strip to annealing, pickling, cold rolling and annealing to provide a final product.

12. A process for producing a thin sheet of Cr-Ni-based stainless steel represented by 18%Cr-8%Ni steel having excellent surface quality and workability, comprising the steps of:

pouring said stainless steel in a molten state into a mold of a continuous casting machine having a mold wall surface that moves in synchronization with a cast strip and effecting rapid solidification at a cooling rate of 100° C./sec or more to continuously cast a cast strip having a thickness of 10 mm or less;

cooling the resultant cast strip after solidification to 1250° C. at a cooling rate of 100° C./sec or more and preventing the occurrence of recuperation;

gradually cooling the cast strip in a temperature range of from over 950° C. to 1250° C. at a cooling rate of 20° C./sec or less for 5 sec to 2 min; and cooling and coiling the cast strip and subjecting the cast strip to annealing, pickling, cold rolling and annealing to provide a final product.

* * * * *

UNITED STATES PATENT AND TRADEMARK OFFICE

CERTIFICATE OF CORRECTION

PATENT NO. : 5,281,284

DATED : January 25, 1994

INVENTOR(S) : Ueda et al.

It is certified that error appears in the above-indentified patent and that said Letters Patent is hereby corrected as shown below:

In Col. 14, line 24, after "550°C." insert --(b) holding at 1050°C. for 100 sec. → air cooling to 900°C. → water cooling from 900 to 550°C. → coiling at 550°C.--

Signed and Sealed this

Thirteenth Day of September, 1994

*Attest:*

*Attesting Officer*

Bruce Lehman

BRUCE LEHMAN

*Commissioner of Patents and Trademarks*